United States Patent [19]

Rosink, deceased

[11] Patent Number: 4,694,540

[45] Date of Patent: Sep. 22, 1987

[54] CAN COILER

[75] Inventor: Albert Rosink, deceased, late of Nordhorn, Fed. Rep. of Germany, by Lieselotte Rosink, heiress

[73] Assignee: Albert Rosink Maschinenbau, Nordhorn, Fed. Rep. of Germany

[21] Appl. No.: 776,944

[22] Filed: Sep. 17, 1985

[30] Foreign Application Priority Data

Sep. 18, 1984 [DE] Fed. Rep. of Germany ..... 3434228

[51] Int. Cl.[4] ..... B65H 54/80

[52] U.S. Cl. ..... 19/159 R

[58] Field of Search ..... 19/159 R, 159 A; 242/82

[56] References Cited

U.S. PATENT DOCUMENTS

| | | | |
|---|---|---|---|
| 3,355,775 | 12/1967 | Whitehurst | 19/159 R |
| 3,387,340 | 6/1968 | Caldwell et al. | 19/159 R |
| 3,470,587 | 10/1969 | Kincaid | 19/159 R |
| 3,938,222 | 2/1976 | Garrison | 19/159 R |
| 4,208,762 | 6/1980 | Starling | 19/159 R X |

FOREIGN PATENT DOCUMENTS

| | | | |
|---|---|---|---|
| 1357187 | 12/1964 | France | 19/159 R |
| 2084199 | 4/1982 | United Kingdom | 19/159 R |

*Primary Examiner*—Louis K. Rimrodt
*Assistant Examiner*—J. L. Olds
*Attorney, Agent, or Firm*—Martin A. Farber

[57] ABSTRACT

A can coiler with sliver inlet opening (1) on its head side, which opening is arranged in a rotating plate (11) and is flanked by calender rolls (16) the drive for which is derived from the rotary motion of the rotating plate (11) in the head of the can coiler. A structural form which is simple to manufacture and favorable in use and for maintenance is provided by the drive of the calender rolls being developed as a belt drive with a friction wheel (13) which can be shifted into position of application against an annular surface (18') of the head (10) of the can coiler.

13 Claims, 8 Drawing Figures

CAN COILER

BACKGROUND AND FIELD OF THE INVENTION

The present invention relates to a can coiler having, on its head side, a sliver entrance opening which is arranged in a rotating plate and is flanked by calender rolls, the drive for which is derived from the rotation of the rotating plate in the head of the can coiler.

Up to now the drive has been effected by bevel-gear or worm-gear drives. A large amount of noise and wear is produced thereby. There is a large expense for maintenance, and in particular frequent lubrication is necessary. Grease lubrication is disadvantageous as the grease may even come onto the product. In addition to this, a substantial amount of dust is produced; as a rule, the dust mixes with the lubricant so that the machine must therefore be constantly checked and cleaned.

The object of the present invention is to develop a can coiler of this type in a manner which is simpler to manufacture and more advantageous in use such that with extremely quiet operation and practically lubrication-free transport the sliver can be coiled cleanly and smoothly in the can.

SUMMARY OF THE INVENTION

Accordingly the drive of the calender rolls is developed as a belt drive with a friction wheel which can be shifted into position of application against an annular surface of the head of the can coiler.

As a result of this development there is obtained a can coiler of this type with gear-less drive of the head and increased value in use. The drive of the calender rolls which is derived from the rotation of the plate is effected via a practically completely silent belt drive. The friction wheel of said drive which can be shifted into position against the annular surface of the head of the can coiler turns reliably and free of slippage. Such a belt drive can be made extremely compact, requires neither lubrication nor other maintenance and is characterized by a long life. In addition, a high rate of rotation can be obtained. One advantageous measure consists, furthermore, in the fact that the friction wheel is urged into the direction of application by the tension of the belt. This assures dependable contact with the annular surface even upon rotation at high speed. No special pressing means or additional structural parts are required. The direction of movement of the belt itself leads to this pressing effect of the friction wheel, the wheel being freely displaceable in the direction towards the annular surface. One especially advantageous solution which is in particular structurally simple is that the shaft of the friction wheel is seated on a connecting bar which is pivoted closer to the center of the rotating plate, i.e. eccentrically mounted, it extends at an acute angle to the radial of the rotating plate. The centrifugal force can even be used as second component in the pressing direction. The corresponding acute-angle alignment to the radial fully prevents the connecting bar from turning over into the other direction, due also to the use of the tension of the belt in the direction of application. Dependable entrainment drive travel takes place. With respect to the means guiding the belt, preferably the belt of the belt drive, in addition to wrapping around a belt pulley of the friction wheel wraps around six additional guide pulleys, one of which is seated at the center of the rotating plate, and two near the periphery approximately on a straight line connecting the remaining three belt pulleys, the latter being arranged on shafts supported parallel to the plane of the plate in such a manner that two belt pulleys lie on both sides of the belt pulley which is seated on the one calender shaft. As a whole, there is thus obtained, with utilization of the inner space of the plate, a favorable approximately equal-sided three-point guidance of the belt. In this connection, it is furthermore favorable for the calender rolls to be diametrically opposite the friction wheel. A protected arrangement of the belt drive means can be obtained in the manner that the rotating plate is shaped as a cup. A good compacting of the sliver in combination with a high degree of smoothing can be obtained by simple means if a sliver guide tube is provided between the bottom of the cup and the calender rolls, the inner opening of which tube continues at the bottom as an angularly extending smoothing slit which is developed as a fillet in the lower side of the bottom of the cup. Protruding fibers from the sliver are avoided. The inherently bulky, relatively wide sliver is definitely reduced in volume by the smoothing slit. A satisfactory cake is formed in the can, advisedly in the shape of a helical depositing which proceeds in ring shape. With the use of the centrifugal force the problem of dust removal can also be very simply solved in the manner that the rotating plate is provided, in the region of the wall of the cup near the calender rolls, with at least one outwardly directed dust blow-out opening and at least one air inlet opening is provided in the cover of the cup-shaped rotating plate nearer the center thereof. The dust produced is thus continuously evacuated; no deposit which disturbs the travel of the belt is formed on the driving or guiding elements. The machine operates excellently. In this connection it is also advantageous for the dust blow-out opening to exit below the annular surface of the head of the coiler can and continue into a blow-out channel extending up to the side wall of the can coiler. Balls of dust or fluff can be removed with the machine in operation and can be easily effected through a dust-removal opening in the upper wall of the channel.

BRIEF DESCRIPTION OF THE DRAWINGS

The present invention is explained in further detail below with reference to an embodiment shown in the drawing, in which.

DESCRIPTION OF THE PREFERRED EMBODIMENT

A sliver L runs to the pair of can coilers for carding, crimping or combining machines. The sliver is a rope of cotton, wool or synthetic fibers.

Figure 5:
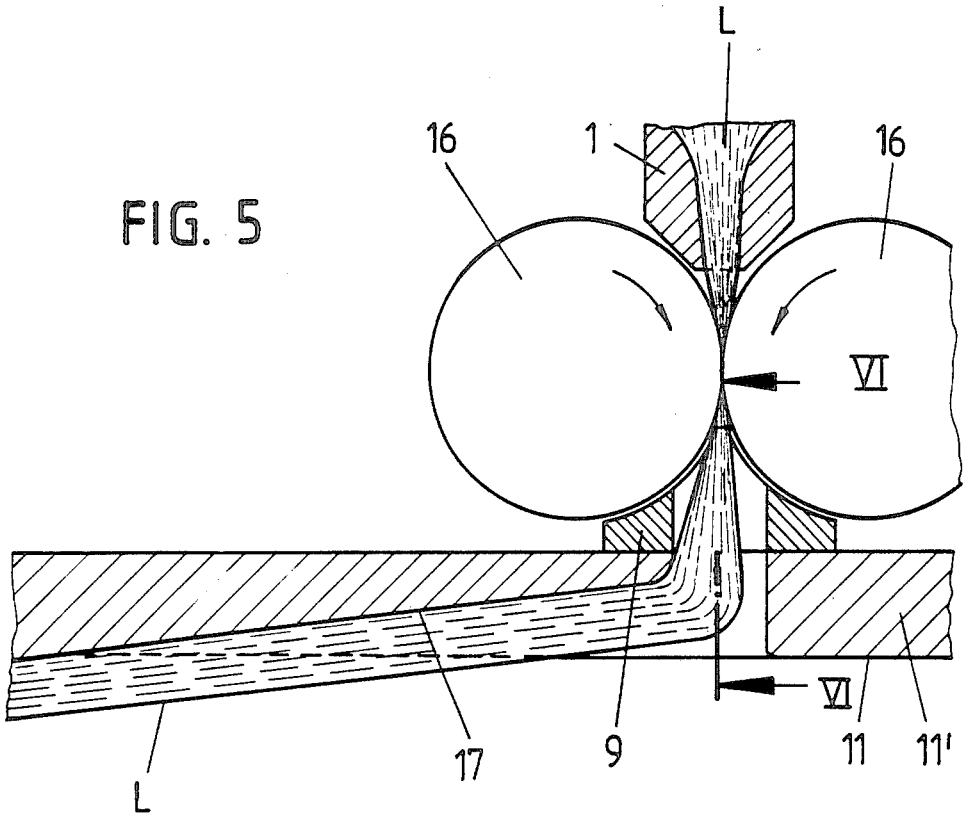
FIG. 5 shows the path of the sliver in the region of the calender rolls.
Figure 6:
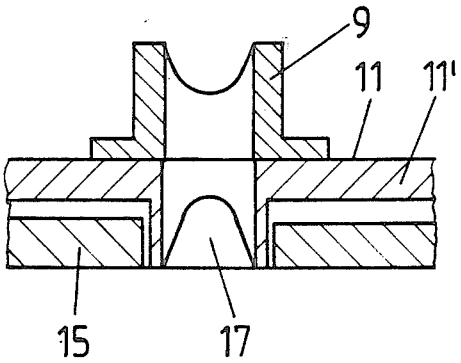
FIG. 6 is a section along the line VI—VI of FIG. 5.

The sliver L enters overhead, guided by rollers, through a nozzle 1 into the head 10 of the can coiler. The vertically directed nozzle 1 extends within the region of the rim of a cup-shaped rotating plate 11. The entrance-side region of the nozzle is widened in funnel shape. The mouth of the nozzle extends deep into the nip of two calender rolls 16 which pull the sliver in and for this purpose are driven synchronously in the direction of the arrows which can be noted from FIG. 5.

Below the two calender rolls 16 the sliver L which has been introduced is pushed through the inner opening of a small guide tube 9 at first downward in vertical direction. The guide tube 9 also extends deep into the nip-like region between the calender rolls 16 and the cup bottom 11' of the rotating plate. The upper end of the guide tube is correspondingly hollowed out so as to be adapted to the cylindrical contour of the calender rolls (see FIG. 2).

Figure 7:
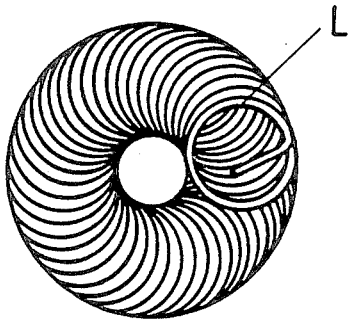
FIG. 7 shows the structure of the sliver which is deposited practically in planetary manner in the can, shown in top view.

The inner opening of the tube continues substantially with the same cross section or with somewhat larger diameter through the cup bottom 11' of the rotating plate 11 in order to pass into an angularly extending smoothing slit 17 which forms a recess. The slit is developed as a recess which is open towards the underside of the cup bottom, namely towards the can side. The smoothing slit, which produces a pulling along in direction, compresses the sliver, i.e. the sliver is reduced in its volume and smoothened. The smoothing slit finally passes, with continuous reduction of its depth, out on the bottom of th2e cup bottom 11, i.e. it thins out. In the previously known sliver guides arranged below calender rolls, the sliver was conducted further in large volume and deposited through a large funnel outlet. The large bore in a rotary funnel which was provided for this purpose frequently caused damage to the sliver upon the pressing. Now the sliver L, upon the pressing of the deposited turns, is pulled protectively through the smoothing slit 17 and is deposited as a coiled ring as a cake in the can, in the manner which can be noted from FIG. 7. This type of deposit is obtained by the eccentric emergence of the sliver on the bottom of the rotating plate 11 and by the fact that the can itself is driven in rotation. For this purpose, the can is seated on a rotary disk which rotates in the horizontal plane and is mounted in the region of the base of the can coiler K. The driving of the rotary disk via a worm shaft 37 places the rotating plate 11 supported in the head 10 of the can coiler in rotation. The vertical axis of said rotating plate is eccentric to the axis of the can. A belt 24 is used as drive means. This belt passes over a bearing ring 25 of the bearing of the rotating plate. The bearing ring extends from an annular flange 26. The latter is seated peripherally on the cup wall 11'' of the rotating plate 11.

The drive of the calender rollers 16 is derived from the rotation of the rotating plate 11. This drive is effected as a belt drive. The elements forming it are arranged in protected manner, including the calender roller 16, in the cup space of the rotating plate, which is furthermore covered by a cover 46.

The transmission of the rotary movement is effected via a friction wheel 13. The latter travels on the annular surface 18' of an annular body 18 which is arranged fixed in position in the head 10 of the can coiler. This inner annular surface 18' extends concentrically to the rotating plate 11 which extends from above into the cavity of the ring. For the free passage of the friction wheel 13, the cup wall 11'' of the rotating plate 11 has a window-like opening 27 in the region of the annular body 18. The peripheral region of the friction wheel 13 which extends somewhat beyond the cylindrical outer surface of the cup wall 11'' can thus be shifted into or reset in that position of application which provides the proper contact. The actual travel surface of the friction wheel 13 is formed by a rubber or plastic body. The latter is placed from above over a hoop-shaped rim 28 of the friction wheel 13 and is secured via a closure ring 29 which is placed on over it via screws 30 which pass through the rubber body and connect the two parts.

The outer surface 18'' which faces away from the annular surface 18' of the annular body 18 receives a wire ring bearing 31 via which the rotating plate 11 is supported in the head 10 of the can coiler by means of the bearing ring 25.

The friction wheel 13 is urged in the direction of application (engagement) against the annular surface 18' of the annular body 18 by the tension of the belt 5. The course of the belt 5 is aligned accordingly for this purpose (see FIG. 4). As can be seen, the friction wheel 13 is furthermore seated on the free end of an eccentrically mounted connecting bar 14. The latter swings around a shaft 19. The shaft 19 extends from the cup bottom 11', in which it is held fast. The swing shaft which bears the friction wheel is marked 32. It is extended upward for the application of the belt pulley 6 which transmits the rotation of the friction wheel 13 to the drive belt 5. Said belt pulley is held by screws 33 on the wheel body (rim 28) of the friction wheel 13. As a result of the hat shape of the rim 28, space is obtained for the connecting bar shaft 19 which extends into the cup space which is open towards the bottom.

The connecting bar 14 extends at an acute angle (angle alpha of 20°) to the radial R of the rotating plate 11. This affords additional security with respect to the application of the friction wheel. In addition to this, there is an application component in the direction of the arrow Fz resulting from the centrifugal force. The component obtained from the tension of the belt 5 is designated by Fr (see FIG. 4).

Figure 1:
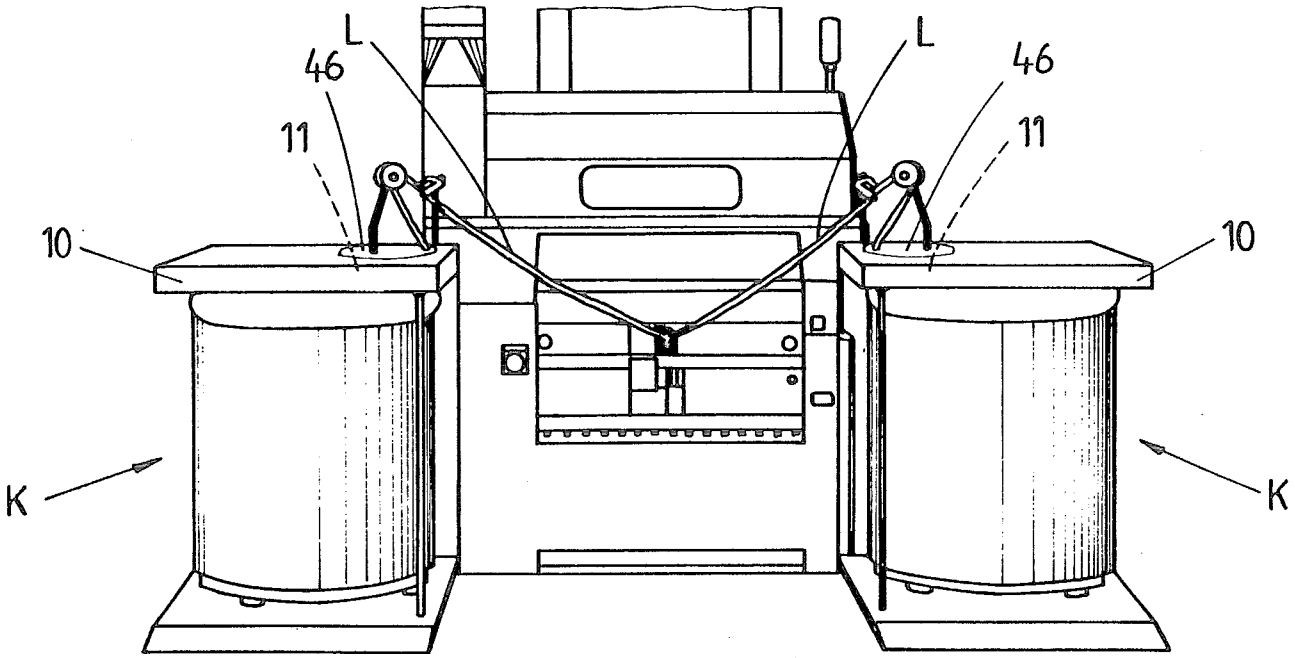
FIG. 1 shows a pair of can coilers for carding, crimping or combing machines, seen in perspective.
Figure 2:
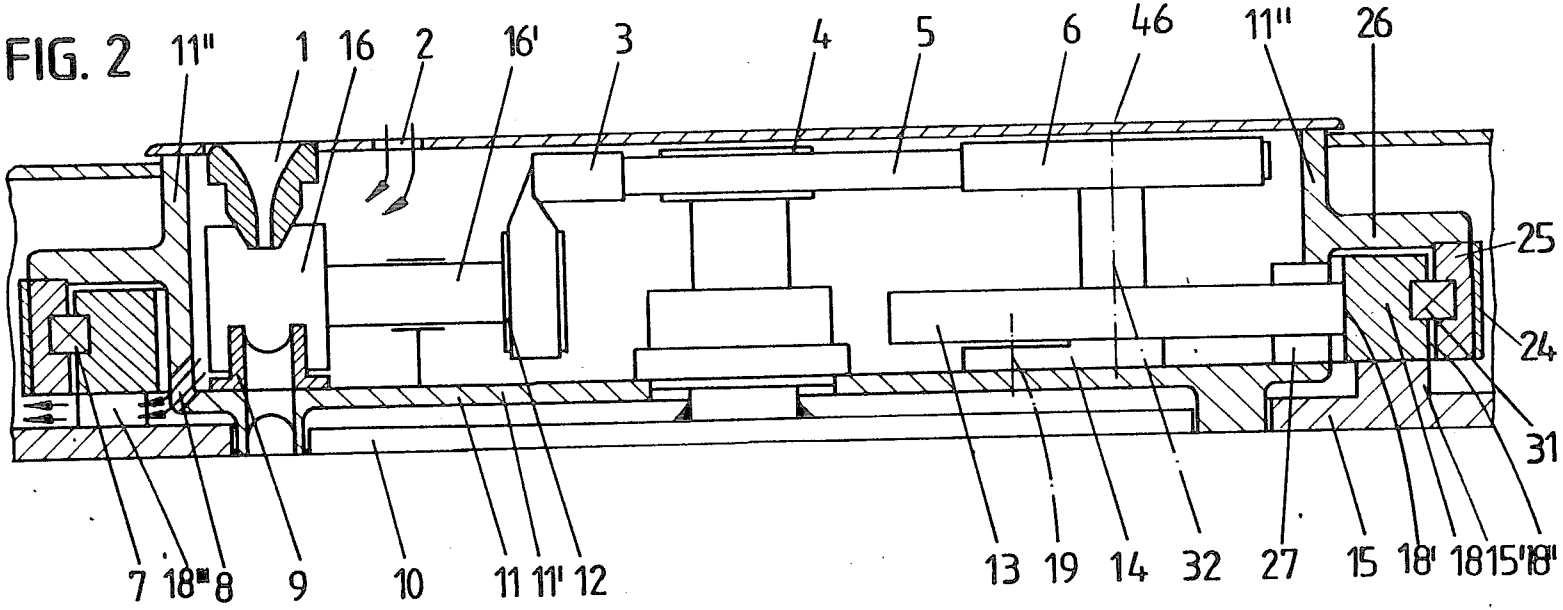
FIG. 2 is a vertical section through the head of the can coiler, shown very schematically and only in part.

In addition to the belt pulley 6 of the friction wheel 13, the belt drive comprises six other guide belt pulleys. One of them—designated 4—is arranged at the center M of the rotating plate 11. Two are arranged, as is the belt pulley 6, in the vicinity of the periphery of the rotating plate. They lie slightly offset from the diameter D-D shown in FIG. 4, namely on the side away from the friction disk 13. These two friction disks, which are of the same diameter, are designated 3. In the tangents of these two friction disks 3 on the calender-roll side which are connected along the shortest path, and therefore on the connecting line z-z, there lie the three other belt pulleys 34, 34 and 12 which are arranged on shafts extending parallel to the plane of the rotating plate in such a manner that two belt pulleys 34, 34 lie on opposite sides of the belt pulley 12, which is seated on a calender shaft 16'. The shafts of the disks 12, 34, 34 which are thus turned by 90°, and therefore into the vertical, lie, as shown in FIG. 2, in a common vertical plane. A v-shaped folding of the section of the belt present there is produced and optimum slip-free guidance of the flat belt 5 is assured.

Figures 3, 8:
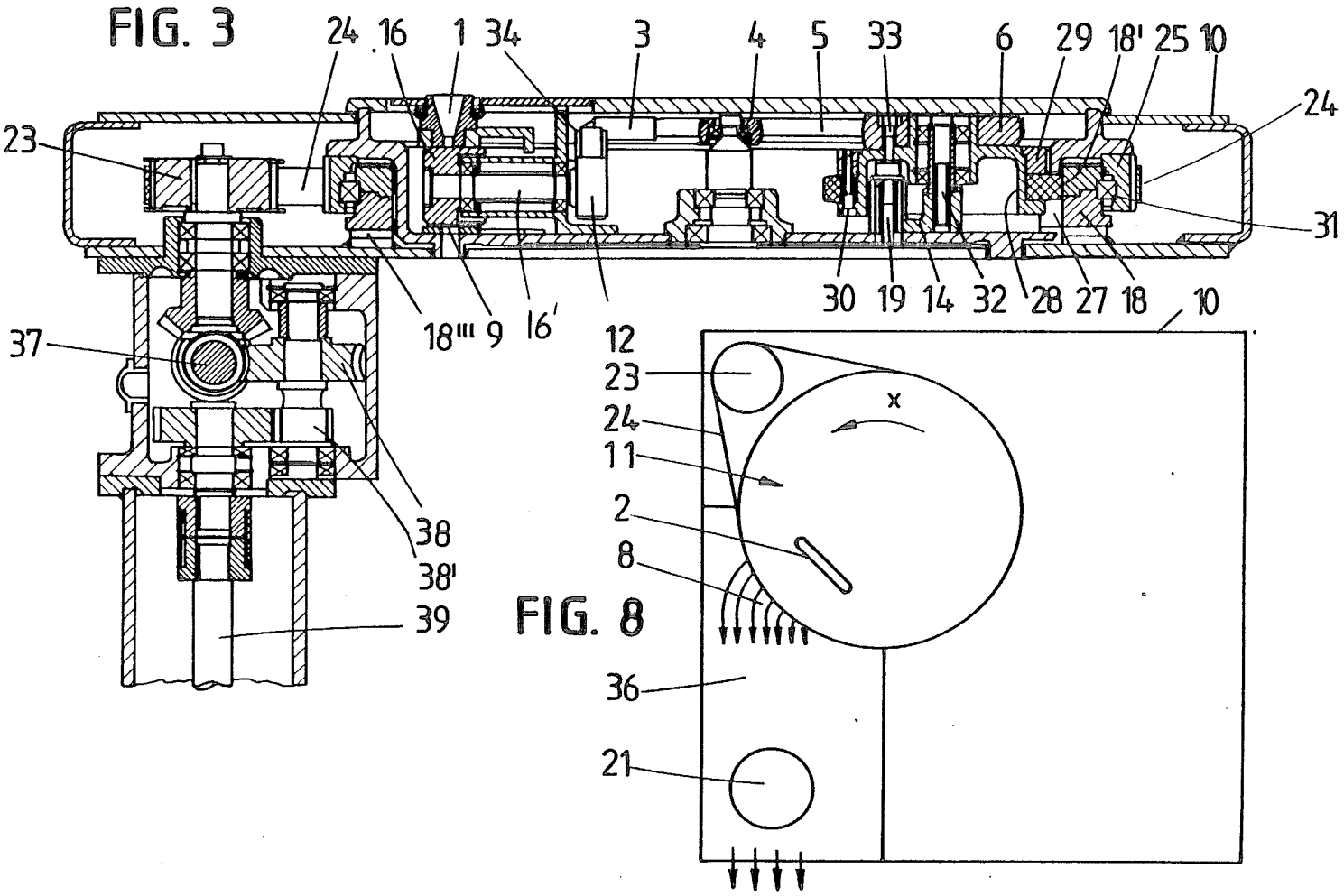
FIG. 3 is a similar section but with preferable details.
FIG. 8 is a top view of the right-hand can coiler showing the means for removing the dust from the cup-shaped rotating plate, again shown very diagrammatically.

In order to increase this folding, the belt pulley 12 is located even somewhat deeper in accordance with FIG. 3.

Figure 4:
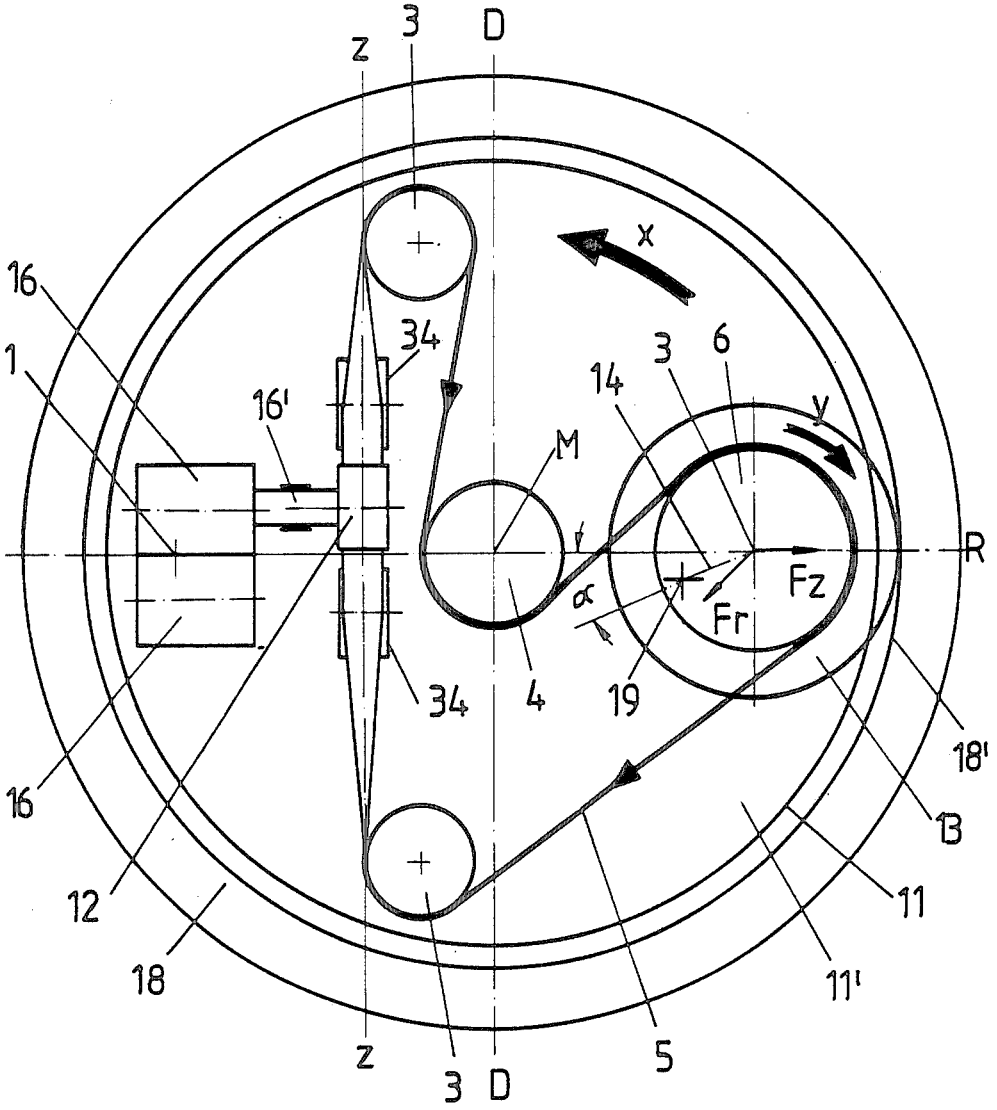
FIG. 4 is a top view of the cup-shaped rotating plate which receives the belt drive, with cover removed, and again in a very diagrammatic view.

The corresponding twist of the flat belt by 90° can be readily noted from FIGS. 2 and 4.

Near the calender rolls 16, the cup wall 11' of the rotating plate 11 has at least one outward-directed dust blow-out opening 8. This is a short slot lying in the region of transition between the cup bottom 11' and the cup wall 11'', extending obliquely downward and outward at an angle of about 45°. The dust or other particles present in this region are thus evacuated in the shortest possible path over this inner corner which forms a natural region of collection, simply by the use of centrifugal force. In the direct vicinity of the nozzle 1 and of the calender roll 16 the cover 46 of the cup-shaped rotating plate 11 has, somewhat nearer to the middle thereof, an air inlet opening 2. It also is developed in the form of a short slot. In this way, particles of dust, fibers, etc. are prevented from entering the region of the belt drive.

As can be noted from FIG. 2, the dust blow-out opening 8 exits below the annular surface 18' of the head 10 of the can coiler. This horizontal passage slot below the annular body 18 is marked 18'''. It is formed as a result of a short interruption of a web 15' which supports said annular body, which web can be developed directly on the bottom 15 of the head of the can coiler.

The passage slot 18''' then continues into a blow-out channel 36 which is directed in the direction towards the side wall of the can coiler. The upper wall of the channel leaves a dust removal opening 21 free. This opening can be closed by a cover.

Briefly summarized, the operation is as follows: Via a drive gearing (not shown in detail), the worm shaft 37 which lies in the region of the head 10 of the can coiler is placed in rotation. Via a sprocket gear 38 which engages into it and an axially adjoining spur gear 38', a vertical spindle 39 is placed in rotation and it, via a disk and a belt drive, places in rotation the rotary disk which receives the can and is arranged centrally on the bottom side of the can coiler. By the same worm shaft 37 the drive disk 23 is driven via a bevel gear angular drive, it placing the rotating plate 11 in rotation. The direction of rotation of the latter is indicated by the arrow x in FIG. 4. The friction wheel 13, which presses against the annular surface 18' as a result of the pull of the belt and the centrifugal force, travels in the direction indicated by the arrow y and thus transmits the required RPM by means of the belt pulley 6 to the flat belt 5 which, via the six further guide disks, finally places the calender rolls 16 in rotation in the direction indicated by the arrow in FIG. 3.

The entering sliver L is pulled-in through the nozzle 1 and strongly compressed there and in the following region of the rolls 16. From there it is pushed through the guide tube 9 so as, via the smoothing slit 17, to enter the inside of the can. The dust produced leaves the region of the calender rolls, assisted by the centrifugal force, through the dust blow-out opening 8 and finally arrives in the blow-out channel 36. There it can be removed via the opening 21 or blown off immediately via means in the side wall of the can coiler.

I claim:

1. In a can coiler with sliver inlet opening on a head side thereof, said opening being in a rotating plate and being flanked by calender rolls, the latter being driven by rotary movement of the rotating plate in a head of the can coiler, the improvement comprising gearless means for driving the calender rolls by said rotary movement of the rotating plate, said means comprises a belt drive and a friction wheel drivably connected to the belt drive, said friction wheel being shiftably mounted so as to be shiftable into a position of rolling frictional engagement against an annular surface of said head of the can coiler by the rotary movement of the rotating plate.

2. The can coiler according to claim 1, wherein said belt drive includes a belt cooperating with said friction wheel so that the friction wheel is biased in a direction of said engagement by tension of said belt of the belt drive.

3. The can coiler according to claim 1, further comprising a connecting bar is pivoted eccentrically to said rotating plate adjacent a center point of the rotating plate, said friction wheel is mounted on said connecting bar, and said connecting bar extends at an acute angle relative to a radial of the rotating plate.

4. In a can coiler with sliver inlet opening on a head side thereof, said opening being in a rotating plate and being flanked by calender rolls, the latter being driven by rotary movement of the rotating plate in a head of the can coiler, the improvement comprising means for driving the calender rolls by said rotary movement of the rotating plate, said means comprises a belt drive and a friction wheel, said friction wheel being shiftably mounted so as to be shiftable into a position of engagement against an annular surface of said head of the can coiler, said belt drive includes, a belt pulley of the friction wheel, and six guide belt pulleys, one of said guide belt pulleys is seated at a center of the rotating plate, two of said guide belt pulleys are disposed in the vicinity of the periphery of said rotating plate approximately aligned with the remaining three of said guide belt pulleys, said three of said guide belt pulleys are arranged on shafts mounted parallel to the plane of the rotating plate in such a manner that two of the three guide belt pulleys lie on opposite sides of the other of said three guide belt pulleys, a shaft of one of said calender rolls is in common with the shaft of said other of said three guide belt pulleys, and said belt drive further includes a belt wrapping around all said belt pulleys.

5. The can coiler according to claim 3, wherein said calender rolls face each other along an extension of said radial on a diameter of said friction wheel.

6. The can coiler according to claim 1, wherein said rotating plate is shaped as a cup.

7. The can coiler according to claim 6, further comprising a sliver guide tube between a bottom of the rotating plate and said calender rolls, said tube has an inner opening continuing on said bottom into a smoothing slit, the latter comprising an angularly extending recess in a lower side of the bottom.

8. The can coiler according to claim 1, wherein said rotating plate has a circumferential wall and a cover thereon, said rotating plate is formed in the region of the circumferential wall adjacent said calender rolls with at least one outwardly directed dust blow-out opening and at least one air inlet opening formed in said cover of the rotating plate closer to the middle thereof than that of said dust blow-out opening.

9. The can coiler according to claim 8, wherein said dust blow-out opening exists below said annular surface of the head of the can coiler and continues into a blow-out channel extending up to a side wall of the can coiler.

10. The can coiler according to claim 9, further comprising an upper blow-out channel wall forming said blow-out channel being formed with a dust-removal opening.

11. The can coiler according to claim 3, further comprising a shaft for said friction wheel and, said shaft is mounted on said connecting bar mounting said friction wheel on said connecting bar.

12. In a can coiler with sliver inlet opening on a head side thereof, said opening being in a rotating plate and being flanked by calender rolls, the latter being driven by rotary movement of the rotating plate in a head of the can coiler, the improvement comprising means for driving the calender rolls by said rotary movement of the rotating plate, wherein said means comprises a belt drive and a friction wheel, a connecting bar is swingably pivoted to the rotating plate, and said friction wheel is mounted on said connecting bar such that said friction wheel is shiftable into a position of frictional engagement against an annular surface of said head of the can coiler, said belt drive includes a belt cooperating with said friction wheel so that the latter is pressed in a direction of said position of frictional engagement against said annular surface of said head by tension of said belt of the belt drive, said belt being driven to drive the calender rolls by rotation of said friction wheel, the latter rotating by travelling on said annular surface of said head by the rotary movement of the rotating plate.

13. The can coiler according to claim 12, wherein said connecting bar is pivoted eccentrically to the rotating plate.

* * * * *